US008747057B2

(12) United States Patent
Holroyd et al.

(10) Patent No.: US 8,747,057 B2
(45) Date of Patent: Jun. 10, 2014

(54) TURBOMACHINE

(75) Inventors: Robert L. Holroyd, Halifax (GB); Tom J. Roberts, Huddersfield (GB)

(73) Assignee: Cummins Ltd., Huddersfield (GB)

( * ) Notice: Subject to any disclaimer, the term of this patent is extended or adjusted under 35 U.S.C. 154(b) by 602 days.

(21) Appl. No.: 12/899,287

(22) Filed: Oct. 6, 2010

(65) Prior Publication Data

US 2011/0103938 A1 May 5, 2011

(30) Foreign Application Priority Data

| | | |
|---|---|---|
| Oct. 6, 2009 | (GB) | 0917513.4 |
| Apr. 6, 2010 | (GB) | 1005680.2 |
| Jul. 30, 2010 | (GB) | 1012767.8 |
| Jul. 30, 2010 | (GB) | 1012769.4 |

(51) Int. Cl.
*F01B 25/02* (2006.01)
*F01D 17/12* (2006.01)

(52) U.S. Cl.
USPC ..... 415/157; 415/165

(58) Field of Classification Search
USPC ..... 415/148, 151, 157, 158, 159, 165, 166
See application file for complete search history.

(56) References Cited

U.S. PATENT DOCUMENTS

| | | | | |
|---|---|---|---|---|
| 4,135,850 | A * | 1/1979 | d'Anjou | 415/148 |
| 5,267,829 | A | 12/1993 | Schmidt et al. | |
| 7,428,814 | B2 * | 9/2008 | Pedersen et al. | 60/602 |
| 2007/0177349 | A1 | 8/2007 | Pokharna et al. | |
| 2007/0209361 | A1 | 9/2007 | Pedersen et al. | |
| 2008/0038110 | A1 * | 2/2008 | Roberts et al. | 415/191 |

FOREIGN PATENT DOCUMENTS

| | | | |
|---|---|---|---|
| JP | 05-133238 | A | 5/1993 |
| JP | 2008-095613 | A | 4/2008 |

OTHER PUBLICATIONS

Chinese Office Action, Nov. 22, 2013, Chinese Patent Application No. 2010106249664.
European Patent Office, International Search Report and Written Opinion, PCT/GB2010/051672, Cummins Ltd., Sep. 9, 2011.

* cited by examiner

*Primary Examiner* — Edward Look
*Assistant Examiner* — Christopher J Hargitt
(74) *Attorney, Agent, or Firm* — Krieg DeVault LLP; Clifford W. Browning

(57) ABSTRACT

A variable geometry turbine comprising: a turbine wheel mounted for rotation about a turbine axis within a housing, the housing defining an annular inlet surrounding the turbine wheel and defined between first and second inlet sidewalls; a cylindrical sleeve axially movable across the annular inlet to vary the size of a gas flow path through the inlet; the annular inlet divided into axially adjacent annular portions by at least one annular baffle which is axially spaced from the first and second inlet sidewalls; inlet formations extending axially across at least two of said annular portions defined by the or each baffle so as to divide said annular inlet into at least two axially offset inlet passages; the baffle(s) and inlet formations forming part of a nozzle assembly located within said annular inlet; wherein first and second components of the nozzle assembly define complementary features which co-operate to connect together said first and second components.

14 Claims, 3 Drawing Sheets

TURBOMACHINE

CROSS REFERENCE TO RELATED APPLICATIONS

Figure 1:
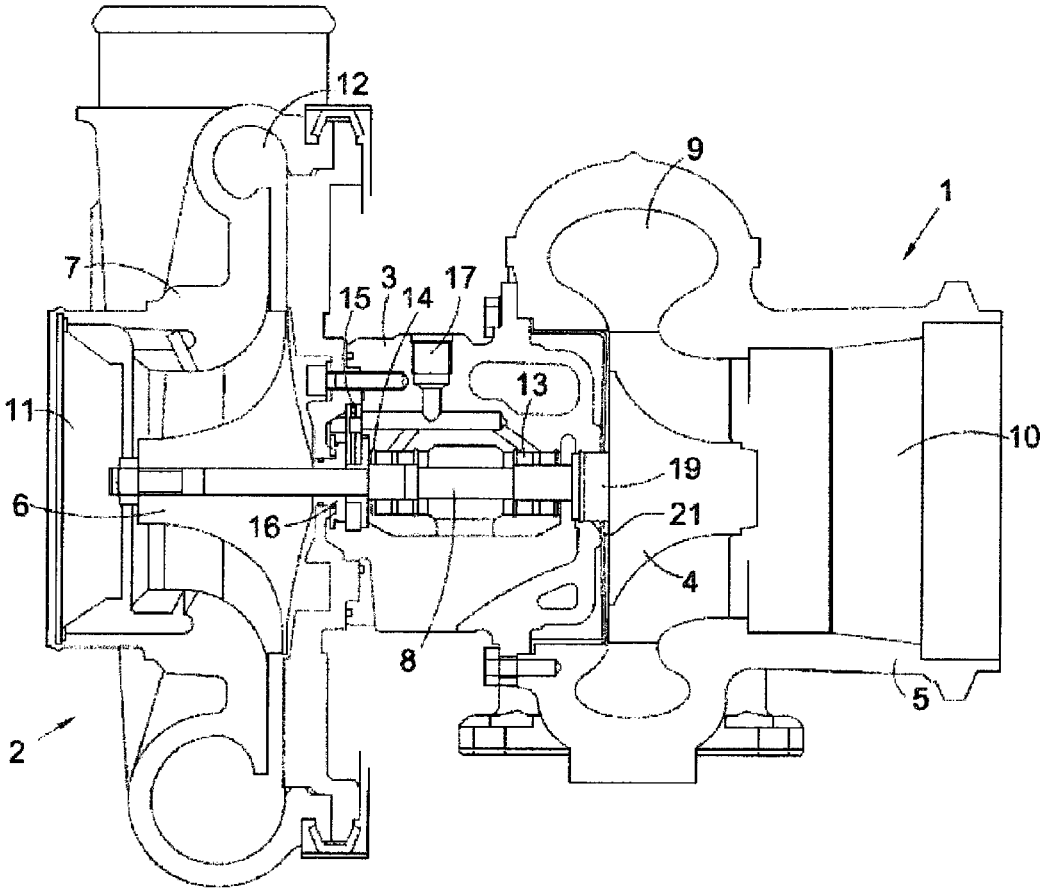

The present application claims priority to United Kingdom Patent Application No. 1012769.4 filed Jul. 30, 2010, United Kingdom Patent Application No. 1012767.8 filed Jul. 30, 2010, United Kingdom Patent Application No. 1005680.2 filed Apr. 6, 2010, and United Kingdom Patent Application No. 0917513.4 filed Oct. 6, 2009, each of which is incorporated herein by reference.

The present invention relates to a turbine suitable for, but not limited to, use in turbochargers and variable geometry turbochargers.

Turbochargers are well known devices for supplying air to the intake of an internal combustion engine at pressures above atmospheric pressure (boost pressures). A conventional turbocharger essentially comprises a housing in which is provided an exhaust gas driven turbine wheel mounted on a rotatable shaft connected downstream of an engine outlet manifold. A compressor impeller wheel is mounted on the opposite end of the shaft such that rotation of the turbine wheel drives rotation of the impeller wheel. In this application of a compressor, the impeller wheel delivers compressed air to the engine intake manifold. A power turbine also comprises an exhaust gas driven turbine wheel mounted on a shaft, but in this case the other end of the shaft is not connected to a compressor. For instance, in a turbocompound engine, two turbines are provided in series, both driven by the exhaust gases of the engine. One turbine drives a compressor to deliver pressurised air to the engine and the other, the "power turbine", generates additional power which is then transmitted to other components via a mechanical connection, such as a gear wheel to transmit power to the engine crankshaft, or via other types of connection, for instance a hydraulic or electrical connection.

It is an object of the present invention to obviate or mitigate one or more of the problems associated with existing turbines.

According to a first aspect of the present invention there is provided a variable geometry turbine comprising:

- a turbine wheel mounted for rotation about a turbine axis within a housing, the housing defining an annular inlet surrounding the turbine wheel and defined between first and second inlet sidewalls;
- a cylindrical sleeve axially movable across the annular inlet to vary the size of a gas flow path through the inlet;
- the annular inlet divided into axially adjacent annular portions by at least one annular baffle which is axially spaced from the first and second inlet sidewalls;
- inlet formations extending axially across at least two of said annular portions defined by the or each baffle so as to divide said annular inlet into at least two axially offset inlet passages;
- the baffle(s) and inlet formations forming part of a nozzle assembly located within said annular inlet;
- wherein first and second components of the nozzle assembly define complementary features which co-operate to connect together said first and second components.

Within each annular portion the axially extending formations may be vanes, the axially extending part of a porous structure, such as a material having a honeycomb-like internal structure, or both. The formations are orientated to deflect gas flowing through the annular inlet towards the direction of rotation of the turbine wheel. Gas is deflected along inlet passages defined between neighbouring formations and adjacent baffles or sidewalls.

The nozzle assembly incorporates the one or more baffles located in the annular inlet and the axially extending inlet formations. The first and second components carrying the complementary features may both be baffles or parts of baffles, they may both be inlet formations or a subsection of inlet formations, or a combination of the two. By way of example, a baffle may incorporate a depression or recess which is complementary to a projection on an inlet formation, such as a vane. Mating receipt of the projection on the vane with the depression on the baffle enables those two components, i.e. the vane and the baffle, to be connected together. In a further example, the first and second components may be sections of a baffle which need to be assembled together to define the final baffle for location within the annular inlet. The two sections may each incorporate a projection with an inverted section which are mirror images of one another and can therefore be assembled together by co-operation of the two projections. The baffle sections could be part or complete annular members which, when assembled together, are axially adjacent, or they could be segments of the annular baffle which are connected together along a radial or near radial edge.

In preferred embodiments the nozzle assembly incorporates three or four baffles spaced axially across the annular inlet of the turbine. The baffles may be considered as being axially "stacked" on top of one another. Each pair of adjacent baffles is provided with a pair of complementary features which co-operate to correctly align the baffles with respect to one another. In this way the stack of three or four baffles can be properly assembled and aligned before being placed into the annular inlet or they can be aligned as each baffle is mounted separately within the annular inlet.

One of the complementary features may be a depression or recess formed into the structure of the relevant component by stamping or any other appropriate means. A complementary feature, such as a projection may also be formed by stamping, or another suitable method. Where components of the nozzle assembly are to be connected together so as to lie axially adjacent to one another, such as a vane and its respective baffle, then it may be preferable for the complementary features to extend axially. Where the components are intended to lie circumferentially relative to one another, such as segments of an annular baffle, then it may be preferable for the complementary features to extend circumferentially and optionally to extend at least partially in a radial direction and/or axial direction.

The nozzle assembly may comprise a plurality of pairs of said first and second components, and/or the nozzle assembly may comprise a plurality of pairs of complementary features. Said pairs of complementary features may be provided in any arrangement, but a preferred arrangement has the complementary features provided in one or more annular arrays. In this preferred arrangement, the pairs of complementary features provided in said annular array, or provided in at least one of said annular arrays, are preferably equi-angularly spaced.

A second aspect of the present invention provides a nozzle for location within an annular inlet of a variable geometry turbine, the nozzle comprising at least one baffle and inlet formations; first and second components of the nozzle defining complementary features; wherein said first and second components define complementary features which co-operate to connect together said first and second components.

A third aspect of the present invention provides a method for assembling a nozzle for location within an annular inlet of a variable geometry turbine, the nozzle comprising at least one baffle and inlet formations; first and second components of the nozzle defining complementary features; wherein the method comprises assembling said first and second components such that said complementary features co-operate to connect together said first and second components.

A fourth aspect of the present invention provides a method for assembling a variable geometry turbine, the turbine comprising: a turbine wheel mounted for rotation about a turbine axis within a housing, the housing defining an annular inlet surrounding the turbine wheel and defined between first and second inlet sidewalls; a cylindrical sleeve axially movable across the annular inlet to vary the size of a gas flow path through the inlet; the annular inlet divided into axially adjacent annular portions by at least one annular baffle which is axially spaced from the first and second inlet sidewalls; inlet formations extending axially across at least two of said annular portions defined by the or each baffle so as to divide said annular inlet into at least two axially offset inlet passages; the baffle(s) and inlet formations forming part of a nozzle assembly located within said annular inlet; first and second components of the nozzle assembly defining complementary features; wherein the method comprises assembling said first and second components such that said complementary features co-operate to connect together said first and second components.

Preferably the variable geometry turbine in the second, third and/or fourth aspects defined above is in accordance with the first aspects of the present invention.

It will be appreciated that by appropriate use of co-operating features in the general manner described above the cost and complexity of manufacturing the nozzle assembly, and therefore the turbine, can be reduced as compared to similar assemblies but which do not incorporate the co-operating features.

The co-operating features may be releasably or non-releasably secured together. For example, the features may be locked or screwed together, or they may be brazed together. The features do not have to be used to secure their respective components together, they may be used simply to self-align the two components during assembly to ensure that when the components are secured together they are in the correct relative orientation.

According to a fifth aspect of the present invention there is provided a variable geometry turbine comprising: a turbine wheel mounted for rotation about a turbine axis within a housing, the housing defining an annular inlet surrounding the turbine wheel and defined between first and second inlet sidewalls; a cylindrical sleeve axially movable across the annular inlet to vary the size of a gas flow path through the inlet; the annular inlet divided into axially adjacent annular portions by at least one annular baffle which is axially spaced from the first and second inlet sidewalls; inlet formations extending axially across at least two of said annular portions defined by the or each baffle so as to divide said annular inlet into at least two axially offset inlet passages; the baffle(s) and inlet formations forming part of a nozzle assembly located within said annular inlet; wherein the nozzle assembly comprises at least two modular components of a first type.

Reference to a "modular component" is intended to refer to a component having a particular design which enables it to be used in a modularised fashion, that is, to be combined with one or more further modular components of the same design to build up an assembly comprised of a plurality of said modular components. In this way, nozzle assemblies of a range of different configurations can be manufactured from relatively few components, thus reducing the cost and complexity of manufacture. It will be appreciated that reference to a "type" of modular component is simply intended to mean that the at least two modular components in the nozzle assembly are substantially (i.e. within manufacturing tolerances) identical in size and shape, and are thus "modular components".

The modular components may be releasably or non-releasably secured together. For example, the components may be locked or screwed together, or they may be brazed together. Moreover, the modular components do not have to connect directly to one another, any number of intermediate components may be provided between the modular components to produce the final nozzle assembly.

A further aspect of the present invention provides a nozzle for location within an annular inlet of a variable geometry turbine, the nozzle comprising at least one baffle and inlet formations; wherein the nozzle comprises at least two modular components of a first type.

Another aspect of the present invention provides a method for assembling a nozzle for location within an annular inlet of a variable geometry turbine, the nozzle comprising at least two modular components of a first type; wherein the method comprises assembling said at least two modular components of a first type.

A still further aspect of the present invention provides a method for assembling a variable geometry turbine according to the fifth aspect of the present invention, wherein the method comprises assembling said at least two modular components of a first type.

It will be appreciated that any one or more of the features of the variable geometry turbine according to the fifth aspect of the present invention may be combined with any one or more of the features of the variable geometry turbine of the first aspect of the present invention.

The baffle(s), inlet formations(s) and/or sliding sleeve may be formed from a material that is a ceramic, a metal or a cermet (a ceramic/metal composite). The metal could be any steel, or a nickel based alloy, such as inconel. Any or all of these components may be provided with a coating, for example on the sliding interface of the nozzle and the sleeve there could be a coating of diamond-like-carbon, anodisation, or tribaloy or a substitute wear resistant coating. The aerodynamic surfaces may be provided with a coating to promote smoothness or resist corrosion. Such coatings could include non-deposited coatings such as a plasma-electrolytic-oxide coating or substitute coatings.

The "throat area" of the annular inlet may be thought of as the maximum gas "swallowing capacity" of the turbine. By using baffles to divide the annular inlet into two or more annular portions the throat area of each annular portion can be independently defined by the arrangement of the inlet formations within each annular portion and the axial width of each annular portion. In this way, the throat area of the annular inlet can be varied between the first and second inlet sidewalls. Preferably the gas flow path through the annular inlet is more constricted nearer to the second inlet sidewall, where the gas flow path through the inlet is narrowest or substantially closed, than closer to the first inlet sidewall. The variation in the degree of constriction may be progressive across the axial width of the annular inlet or may vary discontinuously with intermediate annular portions being less constricted than neighbouring annular portions provided that the gas flow path through an inlet passage closer to the second inlet sidewall is more constricted than the gas flow path through an inlet passage that is further away from the second inlet sidewall. In a preferred embodiment the inlet passages within the turbine having the smallest total cross-sectional area perpendicular to the direction of gas flow are provided in the annular portion nearest to the second inlet sidewall where the gas flow path through the inlet is narrowest or substantially closed.

The axially extending inlet formations are preferably provided in annular arrays within each annular portion. In a preferred embodiment some or all of the formations are vanes. The inlet vanes may have any suitable configuration, and may for example have a similar general aerofoil configuration to that of known inlet vanes, or they may have any alternative configuration selected to define a particular arrangement and configuration of inlet passages. Since the vanes and inlet baffles together define the configuration and orientation of the inlet passages, a wide variety of different inlet passage configurations can be achieved by appropriate design of the individual nozzle vanes in combination with the inlet baffles.

Control of the degree of constriction to the gas flow path through the annular inlet by the arrangement of the formations, e.g. the vanes, can be achieved in a number of ways. For example, one or more, or all, of the vanes within one annular portion may have a thickened leading edge, a larger circumferential thickness, or both, as compared to vanes in other annular portions. In a preferred embodiment, vanes with a thicker leading edge are provided in the annular portion(s) nearer to the second inlet sidewall, i.e. the closed position of the sleeve where the gas flow path through the inlet is at its narrowest, since this is where a greater variation in gas incidence angle is to be expected. By way of a further example, a greater number of vanes may be provided in one annular portion than another. For instance, an annular array of fifteen vanes may be included in the same nozzle assembly as an annular array of only eight vanes. Other arrays may have a different number of vanes, greater than fifteen or fewer than eight, or somewhere in between, e.g. twelve. In another example, the swirl angle of vanes in one annular portion may be greater than that in another annular portion. Moreover, the radial extent, outer and/or inner maximum diameter of vanes in one annular portion may be different to that in another annular portion to provide a different degree of constriction in the two annular portions. It will be appreciated that any one or more of the above modifications in vane structure, arrangement or orientation may be employed to achieve the desired variation in throat area across the axial width of the annular inlet.

For certain engine applications (such as for exhaust gas recirculation, "EGR") it may be desirable to reduce the turbine efficiency in one or more of the arrays of inlet passageways. For example, it may be desirable to reduce efficiency at relatively open inlet widths in some applications. Such reduced efficiency could for instance be achieved by reducing the radial extent of the vanes (as discussed above), increasing the circumferential width of the vanes, or otherwise configure the vanes to reduce the effective inlet area, i.e. the throat area of the annular inlet.

In some embodiments relatively small "splitter vanes" may be located between adjacent pairs of "main" vanes. This arrangement may have the effect of increasing the total number of vanes compared with other embodiments, but the vanes may be provided with a reduced radial extent so that there is a greater radial clearance between the vanes and the turbine wheel. The splitter vanes may be advantageous in some embodiments to reduce vibration excited in the turbine blades.

In some embodiments, the vanes may have a "cut-off" configuration in the region of the trailing edge rather than a full airfoil configuration which can be expected to provide reduced efficiency but which may be useful in some applications. In addition, obstructions may be located between adjacent vanes which could further reduce efficiency.

In certain embodiments it is preferred that the axially movable sleeve can be moved across substantially the fully axial width of the annular inlet so as to substantially close or entirely close gas flow path through the annular inlet.

While the sleeve may be provided on or adjacent to the inner diameter of one or more of the annular baffle(s), on or adjacent to one or more of the outer diameter of the annular baffle(s), or at any intermediate diameter, it is preferred that the sleeve is provided just radially outboard of the outer diameter of the annular baffle(s) such that it contacts or is just clear of the radially outermost surface of the annular baffle(s) during axial movement to vary the width of the annular inlet.

Preferably the sleeve is moveable with respect to the baffle (s). Thus it is preferred that the baffle(s) is/are substantially fixed in position during operation of the turbine such that variation in the axial width of the annular inlet of the turbine is achieved by axial displacement of the sleeve rather than any movement in the baffle(s).

It is preferred that the sleeve is moveable with respect to the inlet formations, i.e. the vane(s) and/or any other kind of flow-guiding structure provided in the annular inlet, such as a honeycomb-type flow-guide. Thus, the inlet formations are preferably substantially fixed in position during operation of the turbine such that variation in the axial width of the annular inlet of the turbine is achieved by axial displacement of the sleeve rather than any movement in the inlet formations.

There may be a single baffle so as to divide the annular inlet into two axially offset inlet portions. Alternatively, there may be two axially offset baffles disposed within the annular inlet so as to define three axially offset inlet portions. As a further alternative there may be two or more axially offset baffles disposed within the annular inlet so as to define three or more axially offset inlet portions.

It should be appreciated that exhaust gas typically flows to the annular inlet from a surrounding volute or chamber. The annular inlet is therefore defined downstream of the volute, with the downstream end of the volute terminating at the upstream end of the annular inlet. As such, the volute transmits the gas to the annular inlet, while the gas inlet passages of the present invention receive gas from the volute. In some embodiments, the first and second inlet sidewalls which define the annular inlet are continuations of walls which define the volute. The annular inlet may be divided into at least two axially offset inlet passages by one or more baffles located in the annular inlet, and which are therefore positioned downstream of the volute.

The turbine of the present invention has been illustrated in the figures using a single flow volute, however it is applicable to housings that are split axially, whereby gas from one or more of the cylinders of an engine is directed to one of the divided volutes, and gas from one or more of the other cylinders is directed to a different volute. It is also possible to split a turbine housing circumferentially to provide multiple circumferentially divided volutes, or even to split the turbine housing both circumferentially and axially. It should be appreciated, however, that an axially or circumferentially divided volute is distinguished from the multiple gas inlet passages present in the turbine of the present invention. For example, the gas inlet passages relate to a nozzle structure arranged to accelerate exhaust gas received from the volute towards the turbine, and optionally to adjust or control the swirl angle of the gas as it accelerates. The multiple gas inlet passages forming part of the present invention may be further distinguished from a divided volute arrangement in that, while the gas inlet passages receive gas from the volute (or divided volute), and split the gas into an array of paths directed on to the turbine, a divided volute receives gas from the exhaust manifold so as to retain the gas velocity in gas pulses resulting from individual engine cylinder opening events.

It will be appreciated that axially offset inlet passages include inlet passages with different axial positions and/or inlet passages with different axial extents. Axially offset inlet passages may be spaced apart, adjacent or axially overlapping.

Advantageous and preferred features of the invention will be apparent from the following description. Specific embodiments of the present invention will now be described, by way of example only, with reference to the accompanying drawings, in which:

FIG. 1 is an axial cross-section through a conventional turbocharger.

Figure 2:
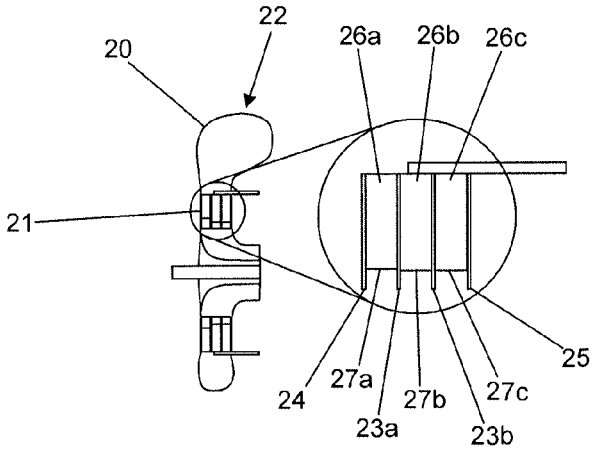
Figure 3A:
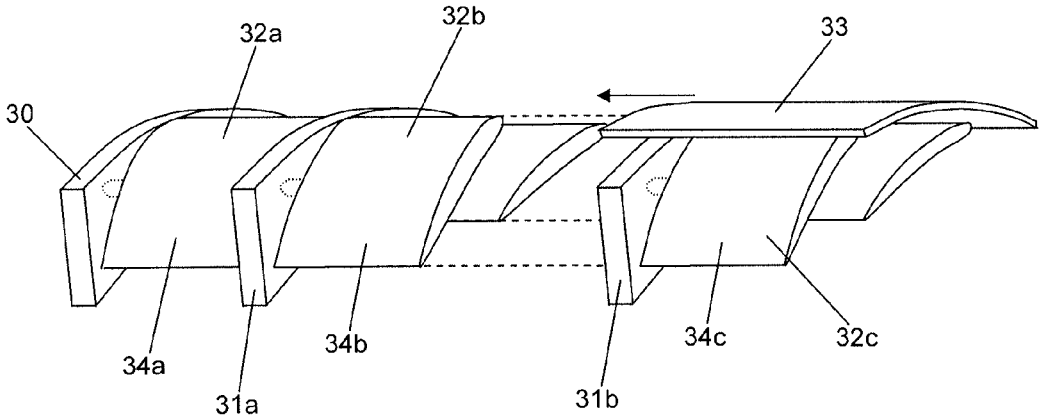

FIG. 2 is an axial cross-section through a turbine volute and annular inlet of a turbine according to an embodiment of the present invention; and FIG. 3*a* is a perspective illustration of components of a section of a nozzle structure forming part of a turbine according to an embodiment of the present invention composed of an inlet sidewalk, baffles, veins and an axially slidable sleeve, in which each vein defines an axial projection that is received in an axial recess defined by an adjacent baffle.

Figure 3B:
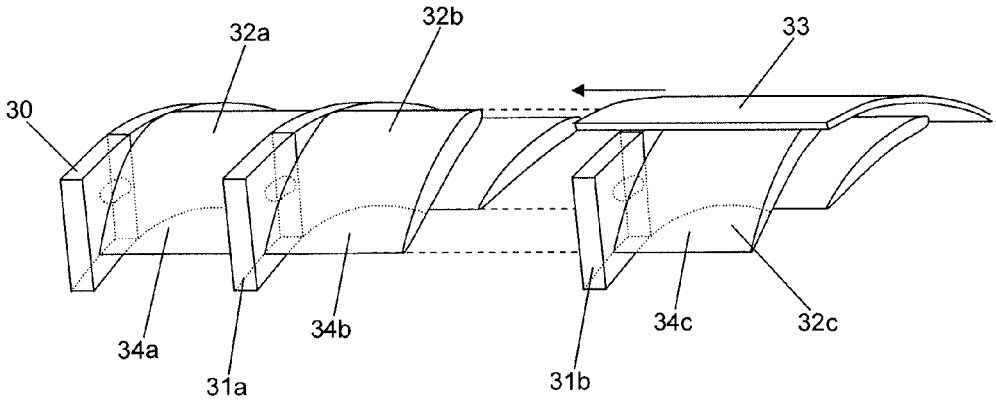

FIG. 3*b* is also a perspective illustration of components of a section of a nozzle structure forming part of a turbine according to an embodiment of the present invention composed of an inlet sidewalk, baffles, veins and an axially slidable sleeve, in which each baffle is made up of multiple circumferentially display sections, each section defining a circumferentially extending projection that is received in a circumferentially extending recess of the neighboring section.

Referring to FIG. 1, the turbocharger comprises a turbine 1 joined to a compressor 2 via a central bearing housing 3. The turbine 1 comprises a turbine wheel 4 for rotation within a turbine housing 5. Similarly, the compressor 2 comprises a compressor wheel 6 which can rotate within a compressor housing 7. The turbine wheel 4 and compressor wheel 6 are mounted on opposite ends of a common turbocharger shaft 8 which extends through the central bearing housing 3.

The turbine housing 5 has an exhaust gas inlet volute 9 located annularly around the turbine wheel 4 and an axial exhaust gas outlet 10. The compressor housing 7 has an axial air intake passage 11 and a compressed air outlet volute 12 arranged annularly around the compressor wheel 6. The turbocharger shaft 8 rotates on journal bearings 13 and 14 housed towards the turbine end and compressor end respectively of the bearing housing 3. The compressor end bearing 14 further includes a thrust bearing 15 which interacts with an oil seal assembly including an oil slinger 16. Oil is supplied to the bearing housing from the oil system of the internal combustion engine via oil inlet 17 and is fed to the bearing assemblies by oil passageways 18.

In use, the turbine wheel 4 is rotated by the passage of exhaust gas from the annular exhaust gas inlet 9 to the exhaust gas outlet 10, which in turn rotates the compressor wheel 6 which thereby draws intake air through the compressor inlet 11 and delivers boost air to the intake of an internal combustion engine (not shown) via the compressor outlet volute 12.

In FIG. 2 there is shown a turbine volute 20 and annular inlet 21 of a turbine 22 according to an embodiment of the present invention. Equiaxially spaced across the inlet 21 are two annular baffles 23*a*, 23*b* which, together with inner and outer sidewalls 24, 25 of the inlet, define three axially offset annular inlet portions 26*a*, 26*b*, 26*c* of equal axial width. Extending axially across each of the three inlet portions 26*a-c* are respective annular arrays of vanes 27*a*, 27*b*, 27*c*. The baffles 23*a-b* and vanes 27*a-c* together represent a nozzle assembly located within the annular inlet 21 which directs exhaust gases flowing from the turbine volute 20 on to the blades of turbine 22 in the most appropriate manner to suit the operating requirements of the turbine 22. While not visible in FIG. 2, each vane in the outer arrays vanes 27*a*, 27*c* incorporates a finger which extends axially inwards from the inner edge of the vane towards the adjacent inner baffle 23*a*, 23*b* respectively, while each vane in the middle array of vanes 27*b* incorporates a pair of fingers one extending axially outwards from each of the opposite edges of the vane which are received in complementary depressions defined by each of the baffles 23*a-b*. In an alternative embodiment, the baffle 23*a* supports the vanes 27*a* and the baffle 23*b* supports the vanes 27*b*. The vanes 27*c* are supported by the inlet sidewall 25. The two baffles 23*a-b* and their respective arrays of vanes 27*a-b* are substantially identical in size and shape and as such represent modular components that have been assembled, together with the vanes 27*c* to provide the nozzle assembly shown within the turbine inlet 21.

FIG. 3 is an illustration of components of a section of a nozzle assembly forming part of a turbine according to an embodiment of the present invention. A perspective view of the nozzle assembly is shown in combination with an inlet sidewall 30 of a turbine inlet passageway. The nozzle assembly comprises first and second axially spaced baffles 31*a*, 31*b* and three annular arrays of axially extending vanes 32*a*, 32*b*, 32*c*. An axially slidable sleeve 33 is disposed around the outer diameter of the vane arrays 32*a-b* and is actuated to vary the axial width of the turbine inlet passageway and in doing so, the "throat" of the turbine. Each array of vanes 32*a-c* is comprised of a plurality of vanes 34*a*, 34*b*, 34*c*. While not visible in FIG. 3, each vane 34*a*, 34*c* in the outer arrays vanes 32*a*, 32*c* incorporates an axially inwardly extending projection which is received in a set of complementary depression formed in the axially adjacent baffle 31*a*, 31*b* respectively, and each vane 34*b* in the middle array of vanes 32*b* incorporates a pair of projections extending axially from the opposite edges of the vane 34*b* which are received in complementary depressions defined by each of the baffles 31*a-b*. In an alternative embodiment, the baffle 31*a* supports the vane array 32*b* and the baffle 31*b* supports the vane array 32*c*. The vane array 32*a* is supported by the inlet sidewall 30. The two baffles 31*a-b* and their respective arrays of vanes 32*b-c* are of modular design and have been produced from the same casting. As such, the nozzle assembly can be manufactured in a more cost-effective manner than if the two baffles 31*a-b* and three arrays of vanes 32*a-c* had been produced separately.

While both of the embodiments shown in FIGS. 2 and 3 employ vanes it will be appreciated that one or more of said vanes or arrays of vanes could be replaced with an alternative form of axially extending formation, such as material having a honeycomb-like internal structure. Moreover, in alternative embodiments the co-operating features may both be defined on the baffles or both on vanes or other axially extending formations.

The invention claimed is:

1. A variable geometry turbine comprising:

a turbine wheel mounted for rotation about a turbine axis within a housing, the housing defining an annular inlet surrounding the turbine wheel and defined between first and second inlet sidewalls;

a cylindrical sleeve axially movable across the annular inlet to vary the size of a gas flow path through the inlet;

the annular inlet divided into axially adjacent annular portions by at least one annular baffle which is axially spaced from the first and second inlet sidewalls;

inlet formations extending axially across at least two of said annular portions defined by the or each baffle so as to divide said annular inlet into at least two axially offset inlet passages;

the baffle(s) and inlet formations forming part of a nozzle assembly located within said annular inlet;

wherein first and second components of the nozzle assembly define complementary features which co-operate to enable said first and second components to be non-releasably secured together.

2. A turbine according to claim 1, wherein said inlet formations are vanes provided in annular arrays within each annular portion.

3. A turbine according to claim 1, wherein said first and second components are baffles, sections of the same baffle, or sections of axially adjacent baffles.

4. A turbine according to claim 3, wherein the first and second components are parts of the same baffle which, when assembled, are disposed axially adjacent to one another, or circumferentially adjacent to one another.

5. A turbine according to claim 1, wherein said first and second components are inlet formations or a subsection of inlet formations.

6. A turbine according to claim 1, wherein said first component is a baffle or part of a baffle and the second component is an inlet formation or a subsection of an inlet formation.

7. A turbine according to claim 1, wherein one of the complementary features is a depression or recess and the other of the complementary features is a projection.

8. A turbine according to claim 1, wherein the nozzle assembly comprises a plurality of pairs of said first and second components.

9. A turbine according to claim 1, wherein the nozzle assembly comprises a plurality of pairs of complementary features.

10. A turbine according to claim 9, wherein said pairs of complementary features are provided in one or more annular arrays.

11. A turbine according to claim 10, wherein the pairs of complementary features provided in said annular array, or provided in at least one of said annular arrays, are equiangularly spaced.

12. A nozzle for location within an annular inlet of a variable geometry turbine, the nozzle comprising at least one baffle and inlet formations; first and second components of the nozzle defining complementary features;

wherein said first and second components define complementary features which co-operate to enable said first and second components to be non-releasably secured together.

13. A method for assembling a nozzle for location within an annular inlet of a variable geometry turbine, the nozzle comprising at least one baffle and inlet formations; first and second components of the nozzle defining complementary features;

wherein the method comprises assembling said first and second components such that said complementary features co-operate to non-releasably secure said first and second components together.

14. A method for assembling a variable geometry turbine, the turbine comprising:

a turbine wheel mounted for rotation about a turbine axis within a housing, the housing defining an annular inlet surrounding the turbine wheel and defined between first and second inlet sidewalls;

a cylindrical sleeve axially movable across the annular inlet to vary the size of a gas flow path through the inlet;

the annular inlet divided into axially adjacent annular portions by at least one annular baffle which is axially spaced from the first and second inlet sidewalls;

inlet formations extending axially across at least two of said annular portions defined by the or each baffle so as to divide said annular inlet into at least two axially offset inlet passages;

the baffle(s) and inlet formations forming part of a nozzle assembly located within said annular inlet;

first and second components of the nozzle assembly defining complementary features;

wherein the method comprises assembling said first and second components such that said complementary features co-operate to non-releasably secure said first and second components together.

* * * * *